US005190492A

United States Patent [19]

Berenguer

[11] Patent Number: 5,190,492

[45] **Date of Patent: * Mar. 2, 1993**

[54] MECHANISM FOR DOLLS ALLOWING SUCKING MOVEMENT

[76] Inventor: Juan J. Berenguer, c/o Sucesores de Jose Berenguer, S.A. Berjusa, Cervantes No. 18, Onil, Alicante, Spain

[ * ] Notice: The portion of the term of this patent subsequent to Mar. 3, 2009 has been disclaimed.

[21] Appl. No.: 750,394

[22] Filed: Aug. 27, 1991

Related U.S. Application Data

[63] Continuation of Ser. No. 584,748, Sep. 19, 1990, Pat. No. 5,092,811.

[30] Foreign Application Priority Data

Apr. 18, 1990 [ES] Spain ..... 9001104

[51] Int. Cl.[5] ..... A63H 3/28; A63H 3/24; A63H 33/26

[52] U.S. Cl. ..... 446/301; 446/304; 446/303; 446/139

[58] Field of Search ..... 446/130, 136, 139, 297, 446/298, 299, 300, 301, 302, 303, 330, 304, 305

[56] References Cited

U.S. PATENT DOCUMENTS

| | | | |
|---|---|---|---|
| 3,232,004 | 2/1966 | Felsher | 446/130 |
| 3,266,187 | 8/1966 | Felsher | 446/130 |
| 3,383,795 | 5/1968 | Ryan et al. | 446/304 |
| 3,918,199 | 11/1975 | De Masi | 446/305 X |
| 5,092,811 | 3/1992 | Bergenguer | 446/301 |

FOREIGN PATENT DOCUMENTS

| | | | |
|---|---|---|---|
| 278595 | 9/1914 | Fed. Rep. of Germany | 446/304 |
| 8700843 | 12/1988 | Spain | 446/301 |
| 2077117 | 12/1981 | United Kingdom | 446/130 |

*Primary Examiner*—D. Neal Muir
*Attorney, Agent, or Firm*—Beveridge, DeGrandi, Weilacher & Young

[57] ABSTRACT

A mechanism for dolls which allows for crying, movement of the lips and swivelling of the eyeballs. The mechanism includes a control circuit and timing element which is connected to a switch placed in the mouth of the doll, a magnetic field detector placed in the proximity of the mouth, a voice apparatus, and a motor attached to a mechanism for moving the lips and eyes. The latter mechanism consists of an eccentrically mounted shaft which is attached to one end of a spring having its other end connected to a piece that ends in the shape of an arrow-head connected to the doll face in the proximity of the mouth of the doll. A pacifier inserted in the mouth of the doll, opens the switch to maintain inactive all the devices. If the pacifier is removed the voice device is activated. A bottle having a magnetic element can be inserted into the mouth, and operates the magnetic field detector to start the motor and operate the lips and the eyes. Upon removal of the bottle the whole mechanism stops; the timing element starts and after an interval the voice device reactivates.

2 Claims, 4 Drawing Sheets

B-B

MECHANISM FOR DOLLS ALLOWING SUCKING MOVEMENT

REFERENCE TO RELATION APPLICATION

This is a continuation of U.S. patent application Ser. No. 07/584,748, filed Sep. 19, 1990 now U.S. Pat. No. 5,092,811.

OBJECT OF THE INVENTION

The present invention provides a mechanism for dolls which cry and suck and in which a crying sound, produced from a voice device, is initiated when a pacifier is removed from the mouth of the doll. When a bottle is placed in the mouth of the doll a device for moving the lips becomes activated, simulating the action of sucking on the bottle. When the bottle is removed from the mouth, the sucking device ceases operation; also a timing device is started and after a certain time, the voice device starts again producing the crying effect. When again the pacifier is placed in the mouth of the doll, both devices stop and the voice device gets set for a new cycle.

BACKGROUND OF THE INVENTION

In the past, many mechanisms have been incorporated in dolls to achieve different functional characteristics.

For example, Spanish Patent No. 8700752 claims a device for the combined movement of the mouth and eyes of dolls.

There are also dolls that incorporate voice devices which allow for crying, laughter, etc.

However, hitherto there has not been known any doll that provides a combination of crying and lip movement by devices which are as simple and economical as is desirable.

SUMMARY OF THE INVENTION

The invention provides a doll having a crying and sucking mechanism in which a voice device and a lip moving device are operated by a timing control circuit The timing control circuit governs the functioning of the system, and includes a switch located in the mouth of the doll, the mouth having an orifice through which a pacifier is inserted to operate the switch.

The timing circuit control is connected to the voice device as well as to a motor that provides the lip movement.

Furthermore, the timing control circuit is connected to a magnetic sensor, located close to the mouth of the doll.

The arrangement is such that when the pacifier is placed through its mouth orifice into the switch located in the mouth of the doll, the control circuit maintains inactive the voice device and the motor and therefore all mechanisms remain inactive.

Once the pacifier is removed from the switch inside the mouth of the doll, the timing control circuit activates the voice device, as a consequence of which the doll starts crying. If, in this situation, a bottle is introduced in the mouth, this bottle containing a magnetic element in its nipple, the magnetic sensor detects the presence of the magnetic element, and the timing control circuit activates the motor, which in turn starts the lip moving device, simulating a child's movements in drinking the bottle.

If the bottle is then removed from the mouth of the doll, the magnetic sensor detects the absence of the magnetic element, and the timing circuit control deactivates the lip and eye movement devices; and, after a predetermined time has elapsed, the control circuit activates the voice device to produce the crying sound.

If the pacifier is inserted again into the switch located in the mouth, this situation is detected by the switch connected to the control circuit, which deactivates all circuits, and the doll is reset for a new cycle.

The lip moving device consists of a vertical eccentrically mounted shaft connected to the motor by gears, this shaft holding one end of a spring which has its other end attached to a connecting piece that ends in shape of an arrow head, this arrow head being anchored in the proximity of the lips of the doll, in such a way that when the motor operates, circular movement of the eccentric shaft causes the displacement of the arrow head shaped piece, and therefore causes movement of the lips of the doll.

BRIEF DESCRIPTION OF THE DRAWINGS

To further describe the invention, attached hereto are drawings which illustrate a preferred embodiment thereof, and in which.

DESCRIPTION OF A PREFERRED EMBODIMENT OF THE INVENTION

Figure 1:
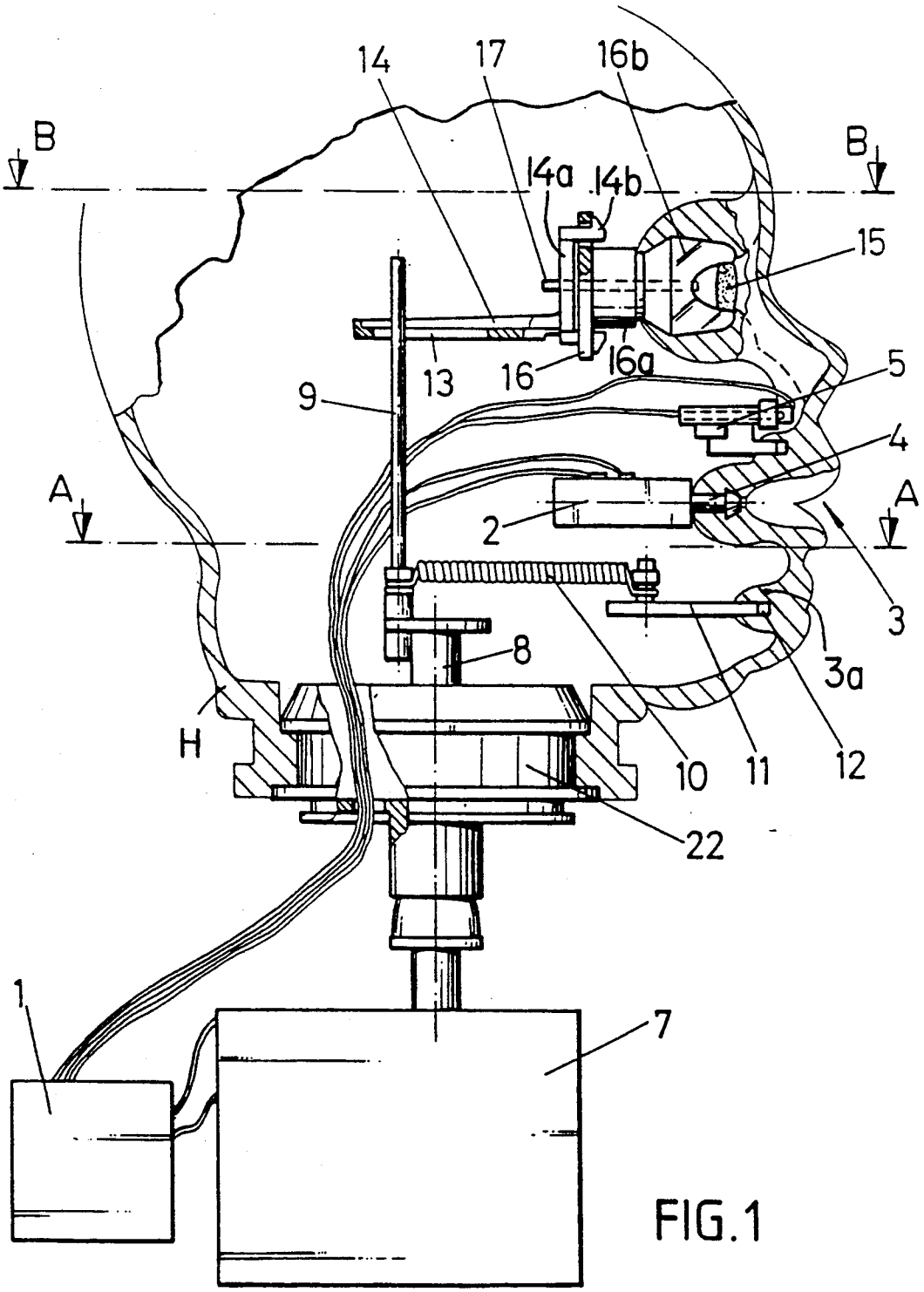
FIG. 1 shows a view in partial section of the head of the doll showing the different devices that allow for the functioning of the system of the invention.
Figure 2:
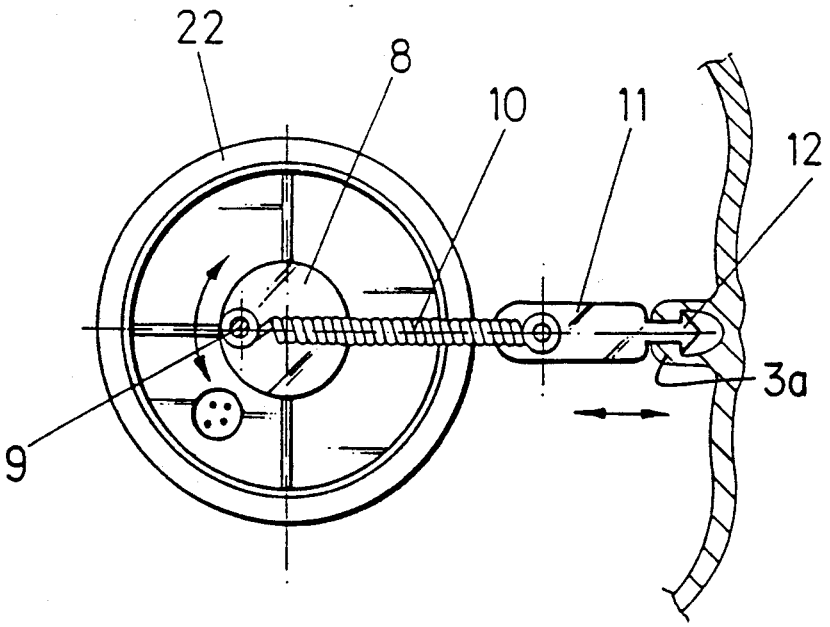
FIG. 2 shows a cross sectional view of the head of the doll on section A—A of the FIG. 1 so that the lip moving device of the doll is shown.
Figure 3:
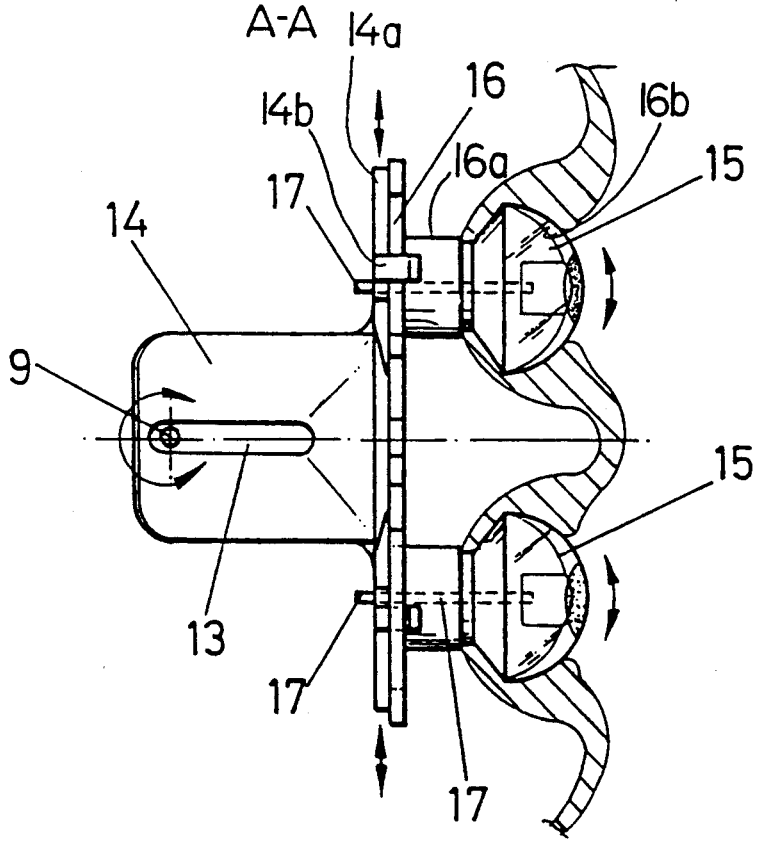
FIG. 3 shows a cross sectional view of the head of the doll on section B—B of the FIG. 1, illustrating a device causing lateral movement of the eyes.

Referring to the drawings, the doll has a head H of pliable, rubber-like molded material, terminating in an annular neck which is a snap fit on an annular groove 22 surrounding a neck piece N; this neck piece also has a lower groove **22*a*** which receives the neck opening of a body portion (not shown).

A timing control circuit 1 is connected to a switch 2 placed in the mouth of the doll 3 and accessible through an orifice 4. In addition, the timing control circuit 1 is connected to a magnetic field detector 5 which is located in the proximity of the mouth 3 of the doll, but which is physically separate from switch 2 as shown in FIG. 1.

The timing control circuit 1 is also connected to a motor 6 placed in a box 7 which through gears drives a cylindrical piece 8, passing through part N, and from piece 8 extends a shaft 9 parallel to the axis of piece 8 but eccentric thereto, and rotatable around that axis. Shaft 9 holds one end of spring 10 which has its other end attached to a piece 11 that ends in the shape of an arrow held 12 having a point which is an interference fit in a cavity formed in an internal protrusion 3a close to and below the mouth 3 of the doll.

The upper part of shaft 9 passes through a slot 13 in an actuator having a base piece 14a slidably held by claws 14b on a support 16 which includes cylindrical extensions 16a connected to the rear of sockets 16b which contain eyeballs 15.

The eyeballs 15 are mounted in sockets 16b with allowance for lateral swivelling, and swivelling movement is controlled by rods 17 passing from the eyeballs, through slots in support 16, and tiltably connected to the actuator base piece 14a. Thus, lateral displacement of the actuator 14 caused by movement of shaft 9 causes swivelling movement of the eyeballs 15.

The doll also incorporates a voice device 18 that incorporates a motor 19 and the diaphragm 20, as well as a needle record (i.e. phonographic device), of such type that when the motor 19 is running the sound recorded can be heard which in this case is the sound of crying of a doll.

The power supply of all systems of the invention is made through the batteries 21.

The operation of the invention will now be described.

The pacifier 23 has a switch operating shaft 24 which is introduced into the orifice 4 to open the switch 2 in the mouth 3 of the doll whereupon the timing control circuit 1 cuts the power of the motors 6 and 19, deactivating the doll circuits.

If the pacifier 23 is removed from the mouth of the doll and therefore from the switch 2, allowing this switch to close, this situation is detected by the timing control switch, which activates the motor 19 of the voice device to produce a crying sound.

Figure 4:
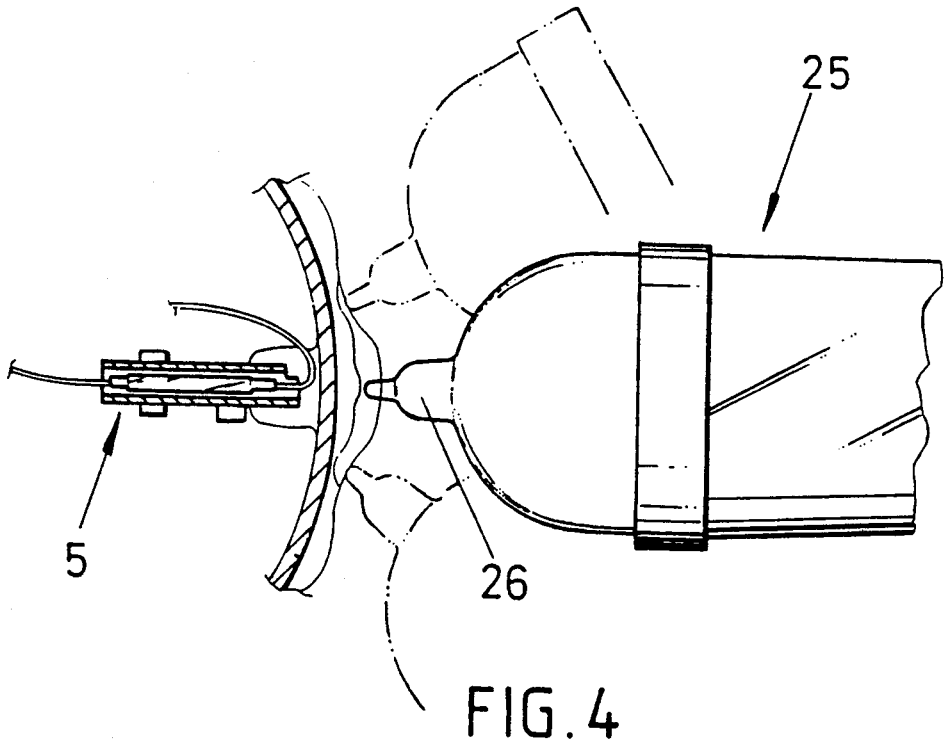
FIG. 4 shows a partially sectional view of the magnetic field detector as well as the bottle and nipple which includes the magnetic element that interacts with the magnetic field detector.
Figure 5:
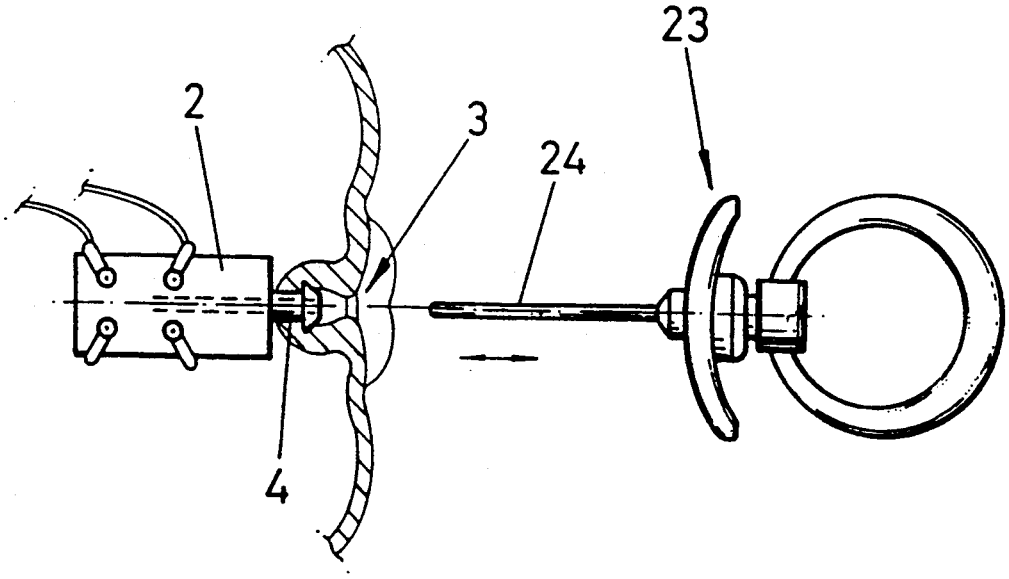
FIG. 5 shows a top view of the switch placed in the mouth of the doll, through its orifice, as well as the pacifier that connects through the mentioned orifice into the switch.
Figure 6:
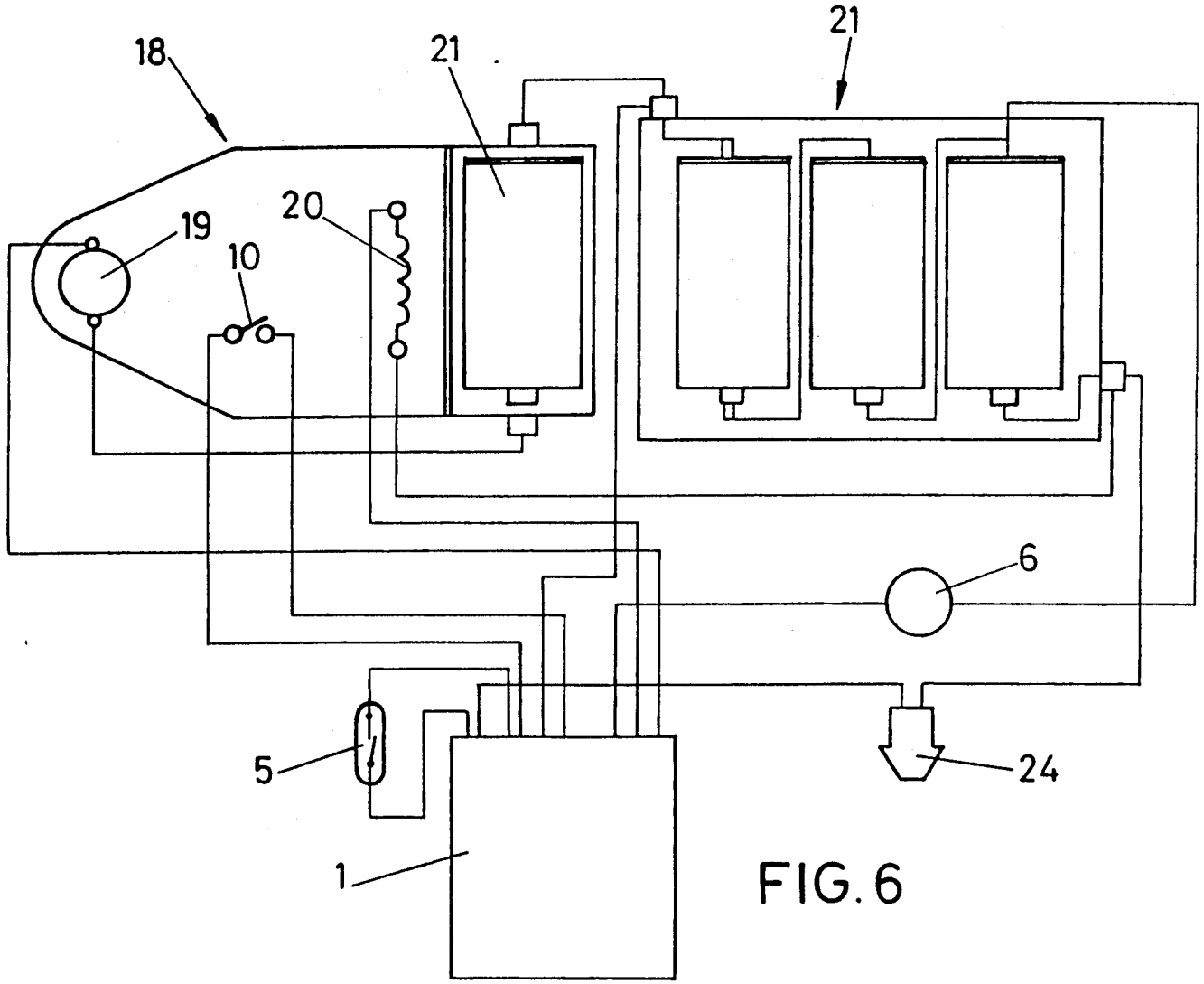
FIG. 6 shows a diagrammatic view of the electrical circuit of the doll.

If, after that, a bottle 25 having a nipple 26 which incorporates internally a magnetic element (FIG. 4) is placed in the mouth, the action of the magnetic element on the magnetic field detector activates the timing control circuit to start the motor 6. This causes the eccentric shaft 9 to rotate so that the force transmitted by the spring 10 produces a displacement of the arrow head shaped piece 11 and accordingly displaces protrusion 3a by which movement of the lips of the doll is produced to simulate sucking on the bottle. Simultaneously, motor 19 is deactivated so that the crying sound ceases.

If, hen, the bottle 25 is removed from the mouth of the doll, the magnetic field detector 5 sends a signal to the timing control circuit 1 which deactivates the motor 6, so that the movement of the lips and eyes stops. Also the timing control circuit 1 is also activated so that once a predetermined time is up, the motor 19 gets activated again and the doll starts crying again.

Therefore, the motor 19 which produces the crying of the doll is deactivated, as long as the pacifier 23 is present into the switch 2, or if the pacifier is disconnected from the switch 2 and the bottle 25 is introduced to the proximity of the mouth 3. If either pacifier or bottle are removed from the mouth of the doll, at that instant the timing starts, and when a time period has elapsed, the crying mechanism is activated again by starting of the motor 19.

Therefore each time the motor 6 is activated, the lateral swivelling movement of the eyes 15 is produced by the action of the transversal displacement of the eccentric shaft 9. It is important to remember that the motor 6 functions as long as the bottle 25 is introduced sufficiently near to the mouth 3 of the doll to activate switch 5.

The timing circuit is also arranged to automatically discontinue the crying sound, after a predetermined period, if the doll is left unattended. The circuit is arranged to be re-activated when the pacifier is inserted into the mouth and subsequently removed.

The record or phonograph type device may be replaced by a so-called "speech chip", specifically a CMOS LS1 (large scale integrated) speech chip, such as are available for example from Eletronic Speech Systems, Inc. of California, U.S.A., and sold under the trade-mark "SOUND MAGICIAN". A suitable chip has the trade designation ES 3016, which is a 20-pin chip with 16384 bytes of onboard ROM (Read Only Memory) and a PLA (Programmable Logic Array). In addition to the crying sound described, such a chip may be arranged to make a sucking sound when the mouth and eye movements are operative, and to make a cooing sound for a few seconds after a nipple has been removed and before the crying starts.

I claim:

1. In combination (a) a doll having a face with lips defining a mouth, and having crying and sucking mechanisms which produce movement of the lips of the doll, and also having a voice device which produces a crying sound, the doll being characterized by a timing-/control circuit which includes the voice device and a motor which moves the lips by operation of said sucking mechanism, said circuit also including:

i) a switch place din said mouth so as to be opened by a shaft inserted into the mouth, this switch being connected to the circuit to operate the voice device to produce the crying sound after the switch has been closed;

ii) a magnetic field detector separate from said switch and located adjacent the mouth, and connected to the circuit to activate the motor and thereby the sucking mechanism;

said timing/control circuit being arranged to activate said motor when the magnetic field detector indicates that a magnetic nipple has been placed in the vicinity of the mouth and to activate the voice device to produce a crying sound at a predetermined time interval after removal of the nipple from the mouth, said switch being operable by said shaft to terminate the crying sound and to de-activate the circuits when the shaft is inserted into the mouth;

(b) a simulated pacifier having a shaft suitable for operating said switch; and (c) a bottle with a magnetic nipple suitable for operating the magnetic field detector.

2. A doll according to claim 1, characterized in that the lip moving device constitutes an eccentrically mounted shaft rotatable by the motor around an axis parallel at all times to the rotatable shaft but displaced therefrom, and a spring, which is attached at one end to the rotatable shaft and at an end remote from said one end to a piece having an arrow head end which arrow head end connects with the doll face in the proximity of the lips of the doll, such that the motor when activated produces the movement of the lips.

* * * * *

UNITED STATES PATENT AND TRADEMARK OFFICE

CERTIFICATE OF CORRECTION

PATENT NO. : 5,190,492

DATED : ~~June 15~~ March 2, 1993

INVENTOR(S) : BERENGUER

It is certified that error appears in the above-identified patent and that said Letters Patent is hereby corrected as shown below:

In Column 3, line 45, change "hen" to --then--.

In Column 4, line 32, change "place din" to --placed in.

Signed and Sealed this

Twenty-fifth Day of January, 1994

Bruce Lehman

*Attest:*

BRUCE LEHMAN

*Attesting Officer*

*Commissioner of Patents and Trademarks*